US005628069A

United States Patent [19]

Ebert

[11] Patent Number: 5,628,069

[45] Date of Patent: May 13, 1997

[54] GLOVE WITH BISTABLE SPRING ELEMENT

[76] Inventor: Gerd Ebert, Amundsenstr. 26, 90453 Nürnberg, Germany

[21] Appl. No.: 591,680

[22] PCT Filed: Aug. 22, 1994

[86] PCT No.: PCT/DE94/00957

§ 371 Date: May 20, 1996

§ 102(e) Date: May 20, 1996

[87] PCT Pub. No.: WO95/05758

PCT Pub. Date: Mar. 2, 1995

[30] Foreign Application Priority Data

Aug. 20, 1993 [DE] Germany ..... 43 28 116.8
Apr. 22, 1994 [DE] Germany ..... 44 14 126.2

[51] Int. Cl.[6] ..... A41D 19/00

[52] U.S. Cl. ..... 2/161.1; 2/160; 2/163

[58] Field of Search ..... 2/159, 160, 161.1, 2/161.2, 163, 167, 255; 482/47, 49

[56] References Cited

U.S. PATENT DOCUMENTS 3,593,803 7/1971 Ibach ..... 2/160
3,835,472 9/1974 Duggins ..... 2/161 A
3,918,096 11/1975 Lim ..... 2/161.1
4,675,914 6/1987 Mitchell ..... 2/161 A
4,830,360 5/1989 Carr ..... 272/67
5,113,526 5/1992 Wang et al. ..... 2/159
5,453,064 9/1995 Williams, Jr. ..... 2/161.1
5,456,650 10/1995 Williams, Jr. et al. ..... 2/161.2

FOREIGN PATENT DOCUMENTS 2237726 5/1991 United Kingdom ..... 2/159

*Primary Examiner*—Michael A. Neas
*Attorney, Agent, or Firm*—Dominik & Stein

[57] ABSTRACT

A glove, particularly a sports glove for motorcycling, skiing or surfing sports or the like, comprises at least one dorsal portion (4), at least one finger portion (6), at least one palm portion (8) and a thumb portion (10), with the at least one finger portion (6) being biasable by at least one spring element (26) toward the closed position of the finger portion (6). The spring element (26) has the form of a bistable spring element (28) which has two stable end positions, with the finger portion (6) being kept deflected toward its closed position in the one end position, and the finger portion (6) being held in a comparatively open position such as the extended position in the other end position. The bistable spring element (28) is a metal leaf spring which reverses under the influence of an external force between a substantially extended/rectilinear orientation corresponding to the extended position and an arcuately curved orientation corresponding to the closed position.

22 Claims, 3 Drawing Sheets

GLOVE WITH BISTABLE SPRING ELEMENT

BACKGROUND OF THE INVENTION

1. Field of the Invention

The invention concerns a glove, in particular a sports glove for the motorcycle, skiing or surfing sports etc.

2. Description of the Related Art

In many sports, gloves are used to protect hands and/or fingers against injury, cold, wind, rain etc. For the gloves to be able to fulfil all or only several of these protective functions, a certain minimum thickness of the glove material must be provided in processing them. Gloves for motorcyclists, for example, are to protect the hands and/or fingers not only against the influence of wind together with rain or cold, but must also prevent injury to hands or fingers as far as possible in the event of a fall. Particularly motorcycle gloves are for this reason manufactured of comparatively thick material to satisfy the demands made to them as well as possible.

Nevertheless, a compromise must be made in manufacturing, say, motorcycle gloves but also gloves for other sports such as skiing or surfing, for the glove material cannot be given just any desirable thickness. Even though an especially thick material would make for a particularly abrasion-resistant and sturdy motorcycle glove for the case of falls, such a motorcycle glove would eventually have such a great stiffness that a bending motion of the single fingers toward the closed position of the hand in order to close a grip, e.g. on the motorcycle handlebar or hand throttle, would require too much strength. A motorcycle glove of such a thick material would furthermore be disadvantageous inasmuch as the actions required to actuate switches e.g. for turn signal, headlight etc. could in this case not be performed conveniently and with a sure aim any more. The gloves, particularly motorcycle gloves, must consequently be manufactured with smaller material thicknesses than is actually desirable under the aspect of safety.

This problem of gloves becoming bulky and awkward whenever the material thickness is selected to provide optimum protective function, whereby particularly the bending motions of the single fingers toward the closed position of the hand and above all maintaining this closed position demand excessive strength, is also met in other sports gloves, for example skiing gloves.

In order to remedy this problem at least approximately, it is known to anatomically preform the glove. As a rule, this is achieved by the palm portion of the glove having a reduced longitudinal extension in comparison with the dorsal portion, whereby a glove thus manufactured receives a pre-bend approximately corresponding to the bent position of the fingers in the relaxed rest position of the hand.

Examples of such pre-bent gloves are described in AT-PS 170 496, DE-OS 23 08 245 and DE-PS 22 54 675.

Although wearing comfort is increased by the anatomical adaptation of such a glove to the natural, relaxed hand position, there nevertheless still occur problems with wearing such a glove whenever a tubular component is to be encompassed by the gloved hand, such as in the case of the handlebar or hand throttle of a motorcycle, the handle portion of a ski stick or the mast of a surfboard or sailboard. Depending on the diameter of the tubular component, the fingers of the hand must be bent more or less strongly toward the closed or fist position of the hand and kept in this position. The force required to move the single glove fingers into the bent position by overcoming the inherent stiffness of the glove material and particularly to maintain them there—even over a prolonged period of time in the case of a motorcycle glove—increases with the degree to which the single fingers must be bent or crooked.

Even anatomically pre-bent gloves such as those in accordance with the above mentioned documents are hardly fit to remedy this drawback because the pre-bend of those known gloves substantially conforms with the curvature of the human hand in its relaxed rest position; even stronger pre-bending of the single fingers is, however, for the most part undesirable as it would first of all give the glove an unappealing, claw-like appearance and would furthermore make it difficult to put on and take off such a strongly pre-bent glove. In addition, the stiffness of the glove material would equally have to be overcome in order to move the fingers from the crooked position, corresponding to a closed position, into an approximately straight position corresponding to the extended position, with the additional difficulty of having to overcome the dispositions (cutting or the like) producing the strong pre-bend of the glove fingers. It is moreover generally known that the human hand is capable of generating great forces while moving the fingers from their extended positions into the closed positions, whereas the forces applicable by a hand in the reverse direction are comparatively small. Transferring a strongly pre-bent glove from the closed positions to the extended positions of its fingers would consequently be extremely difficult and strenuous.

From DE-GM 79 12 393 a generic glove has become known. This glove is characterised by being equipped with one or several spring elements biasing the glove fingers into a closed gripping position. In accordance with DE-GM 79 12 393, these spring elements preferably are inflatable air cushions disposed on the outside of the glove fingers, and in a given case also on the outside of the glove thumb. Owing to these air cushions—where at all capable to retain air over a prolonged period of time —the single glove fingers and the thumb, if provided for, are urged into a closed position. Although the problems described in the introduction, which may occur in a sports glove whenever strong bending or crooking of the glove fingers is required for gripping an object over a prolonged period of time, are overcome by the generic glove, this advantage can only be obtained by incurring the drawback also described above, namely that such a glove permits gripping motions only against resistance and may—if at all—be shifted into an extended position of the glove fingers only by exerting great force. The generic glove in accordance with DE-GM 79 12 393 moreover suffers from the disadvantage of the claw-like appearance mentioned above even when not in use.

SUMMARY OF THE INVENTION

In view thereof, it is the object of the present invention to furnish a glove in such a way that it permits the movement of the glove fingers from their extended positions into their closed positions and back again while maintaining the extended and closed positions is, however, assisted.

A glove according to the invention, in particular a sports glove for motorcycling, skiing or surfing or the like, thus comprises at least one dorsal portion, at least one finger portion, at least one palm portion and a thumb portion, with the at least one finger portion being biasable toward the closed position of the finger portion by at least one spring element. The glove according to the invention is characterised in that the spring element is a bistable spring element having two stable end positions, wherein the finger portion is kept deflected toward its closed position in the one end position and is held in a comparatively open position such as the extended position in the other end position.

Owing to use of the spring element in the form of a bistable spring element having two stable end positions, the closed position as well as the extended position are spring-supported, with the respective movements from the extended position into the closed position and vice versa remaining unaffected. It is thus possible with the glove according to the invention to maintain the glove fingers in the closed position at reduced expenditure of force even over a prolonged period of time, which is most desirable e.g. in a motorcycle glove. Due to the stable end position of the spring element, inherent resetting forces resulting from the stiffness of the respective glove material used are neutralised or at least weakened considerably, whereby the gloved hand has to produce much less force in order to keep the glove fingers in the closed position, in which position e.g. the handlebar or hand throttle of a motorcycle, the handle portion of a ski stick or the mast of a surfboard is gripped. Upon moving the gloved hand from the closed position into the extended position, the one stable end position of the bistable spring element, i.e. the stable end position corresponding to the closed position, is overcome and the bistable spring element may be shifted into its other stable end position corresponding to the extended position of the glove fingers, possibly aided by the other hand.

The term "extended position" within the framework of the invention should not be understood to express that the glove fingers or the fingers of a hand protected by the glove of the invention are unnaturally extended into a perfectly straight position in which the back of the hand and the plane of the extended fingers would substantially be contained in one plane, but the glove fingers still have a slightly curved position owing to the inherent elasticity of the glove material, such that the "extended position" at least approximately corresponds to the relaxed rest position of a hand.

A hand protected by the glove of the invention may thus be moved from its closed position into the extended position and back into the closed position, or remain in the closed position or the extended position, with maintaining either the closed or extended position being possible at small or even no exertion at all thanks to the spring support.

A person wearing the glove of the invention or the gloves of the invention can therefore wear this glove or these gloves even over a prolonged period of time without substantial fatigue phenomena arising in the hand and/or the finger muscles of the forearm because the closed and extended positions are stabilised thanks to the two stable end positions of the bistable spring elements.

The finger portion preferably comprises single glove fingers, the glove of the invention thus being designed in the manner of a glove as opposed to a mitten. In certain applications of use it may be sufficient or advantageous, respectively, to dispose one bistable spring element in at least one glove finger, i.e. in the glove finger for the index finger and/or the one for the middle finger and/or the one for the ring finger and/or the one for the small finger. It may thus be advantageous if for example only the glove finger for the small finger and/or the one for the ring finger is equipped with a bistable spring element, as experience teaches that these fingers are capable of only generating smaller forces in comparison with the middle and index fingers.

If—in accordance with another advantageous embodiment—each glove finger of the finger portion is equipped with a bistable spring element, this results in homogeneous support for the entire hand protected by the glove of the invention in either of the closed and extended positions.

If the bistable spring element in the respective glove finger extends from the tip approximately as far as into the region of the second finger joint, this results in the gloved hand being supported in the region of the last finger joint which is capable of exerting the least force due to its anatomy when moving from the extended position into the closed position, and particularly when maintaining the closed position, especially over a prolonged period of time.

Another embodiment concerns the bistable spring element in the respective glove finger extending from the tip approximately as far as into the region of the first finger joint. Particularly in the case of very bulky gloves or gloves manufactured of material having a particularly great flexural stiffness, there is thus better support for the gloved hand over the entire length or substantially the entire length of the finger.

The bistable spring element in the respective glove finger may finally extend from the tip beyond both finger joints and the knuckle joint as far as into the region of the dorsal portion. Besides a particularly pronounced assistance for the finger movement from the extended position into the closed position and support for the hand in the closed position, this alternative embodiment results in protection or a kind of armoring for all of fingers, phalanges and joints, including the knuckle joint which is highly likely to suffer an injury when a motorcyclist or a skier takes a fall.

In this context, the "first" finger joint shall be defined to be the one following the metacarpophalangeal or knuckle joint, i.e. the joint between the proximal and middle phalanges. The "second" finger joint is defined to be the one to which the distal phalanx comprising the finger pad connects.

As an alternative for the advantageous embodiment wherein a bistable spring element is disposed in at least one or in each glove finger, the glove of the invention may advantageously also be designed to have two bistable spring elements disposed in each glove finger. Particularly if the material from which the glove of the invention is manufactured is particularly stiff or inelastic, the movement from the extended position into the closed position may advantageously be assisted by providing two bistable spring elements for each glove finger.

In the embodiment of the glove of the invention including two bistable spring elements for each glove finger, the two bistable spring elements are for example disposed consecutively in the longitudinal direction of the glove finger. According to one embodiment, the first spring element extends from the glove finger tip approximately as far as into the region intermediate second and first finger joints, and the second spring element extends from a region in the approximate vicinity of the first finger joint beyond the neighboring knuckle joint into the region of the dorsal portion of the glove. Owing to such consecutive arrangement of the two spring elements when viewed in the longitudinal direction, there results a uniform support for the force to be exerted by the gloved finger or hand, respectively, particularly when maintaining the closed position, such as e.g. when encompassing a handlebar or a hand throttle of a motorcycle etc. In this arrangement of the two consecutive bistable spring elements, the first finger joint moreover remains free, i.e. none of the bistable spring elements is disposed in the region of the first finger joint, whereby this first finger joint which—for anatomical reasons—has to be flexed by the largest amount when moving into the closed position and maintaining the closed position, does not experience any restriction in this flexing movement.

Another embodiment of the glove of the invention comprising two bistable spring elements for each glove finger would be to have the first spring element extend from the tip of the glove finger approximately into the region intermediate first finger joint and the neighboring knuckle joint, and to have the second spring element extend beyond the knuckle joint into the region of the dorsal portion. This embodiment particularly results in effective protection for finger and knuckle joints, together with effective assistance for the hand when moving from the extended position into the closed position, and particularly when maintaining this closed position.

In one embodiment, the bistable spring elements are preferably disposed in the dorsal areas of the glove fingers. Apart from the facts that the insides of the fingers hereby remain free in the sense of being covered only by the glove material, and that the sensory faculties are not impaired when gripping, the arrangement of the spring elements in the dorsal areas of the glove fingers furthermore results in the advantage that the glove fingers hereby receive additional protection. The finger joints, and in a given case also the knuckle joints, are hereby additionally protected against injury e.g. in the case of a motorcyclist taking a fall.

The bistable spring elements may nevertheless also be disposed on the insides of the glove fingers. Particularly in the case of thick gloves e.g. of leather, where sensory faculties are anyway strongly restrained, the bistable spring elements also permit their arrangement on the insides of the glove fingers without substantial losses of wearing comfort having to be taken into account.

It may also be advantageous to dispose the bistable spring elements on the outside and inside of each glove finger. In this case, for example, the bistable spring element disposed on the outside may extend from the glove finger tip into the region intermediate first finger joint and adjacent knuckle joint, and the spring element disposed on the inside of the glove finger may extend from a region intermediate first finger joint and knuckle joint into the palm portion. Hereby the spring element disposed on the inside is not bent as strongly as the spring element disposed on the outside when maintaining the hand in the closed position, such that wearing comfort is not impaired. The finger pad is furthermore left free in this case, i.e. not covered by a spring element, such that at least the sensory faculties of the finger pad are not entirely blocked.

The bistable spring elements preferably have different lengths in the single glove fingers in order to obtain optimum adaptation to the glove fingers which are formed to have different lengths.

The bistable spring elements are preferably embedded between exterior material and lining material of the glove fingers. The aesthetic appearance of the glove on the one hand and the wearing comfort of the glove on the other hand are thus not impaired by the spring elements.

If at least one bistable spring element is also disposed in the thumb portion of the glove, maintaining the thumb or the thumb portion of the glove, respectively, in the closed position may also be supported.

As an alternative for designing the glove of the invention to have four finger portions and a thumb portion, the glove of the invention may also be designed as a mitten with the finger portion being shaped in one part. In this case, at least one, however preferably several bistable spring elements in parallel orientation may be disposed in the finger portion, whereby the advantages of a glove may also be obtained in a mitten.

The bistable spring elements are preferably metal leaf springs which reverse, upon application of external force, between a substantially extended/rectilinear orientation corresponding to the extended position and an arcuately curved orientation corresponding to the closed position. This provides the initial advantage that such metal leaf springs are inexpensive and may be manufactured at little expense to have practically any desired length and width, with the additional possibility of adjusting the spring characteristic or strength largely as desired. In addition, designing the spring elements in the form of leaf springs has the advantage that the backs of the fingers and in a given case also the finger and/or knuckle joints—in conformity with the above explanation —receive a kind of armoring by the strip-shaped design of the leaf springs if these spring elements or leaf springs, respectively, are disposed in the dorsal regions of the glove fingers. Especially in the case of gloves for motorcyclists, but also gloves for skiers, such additional joint armoring or such additional joint protection may be highly valuable.

The leaf springs are preferably formed to have a trough-like cross-section comprising laterally raised lateral portions in the extended/rectilinear orientation and to have an approximately level cross-section in the arcuately curved orientation. In either one of the extended/rectilinear and arcuately curved orientations, these bistable spring elements are in a stable end position, i.e. the influence of weak forces or deformation movements of the leaf springs in the respective end positions will not induce the leaf springs to immediately abandon these end positions. Impacts, knocks or vibrations as may occur e.g. in motorcycling but also in windsurfing etc. do thus not immediately result in the spring elements snapping out of one of these end positions, such that particularly maintaining the closed position is effectively supported even when the spring elements or leaf springs, respectively, are subjected to intense stresses.

The force for inducing the reversing movement of the leaf springs into the closed position is preferably applied by a person wearing the glove through corresponding finger movements. That is, the spring force or spring characteristic of the leaf springs should preferably be adjusted such that, although effective support of the gloved hand is performed particularly when maintaining the closed position, the forces applied by the spring elements or leaf springs, respectively, are nevertheless not strong enough to keep a person wearing the glove or gloves of the invention from easily shifting the hand from the closed position into the extended position.

The leaf springs are preferably provided with a protective coating, particularly of elastic plastic material. On the one hand, it is hereby ensured that the lining material, or even the exterior material of the glove, or neighboring quilting seams or the like will not be damaged or severed by the edges of the leaf springs which may moreover be rounded, and such a plastic coating furthermore constitutes effective protection against corrosion, which is particularly advantageous if the glove of the invention is exposed to an aggressive environment in terms of corrosion, which is e.g. true for windsurfing where the leaf springs may possibly get into contact with salt water.

BRIEF DESCRIPTION OF THE DRAWINGS

Further details, aspects and advantages of the present invention result from the following description in conjunction with the drawing, wherein.

DETAILED DESCRIPTION OF THE INVENTION

Figure 1:
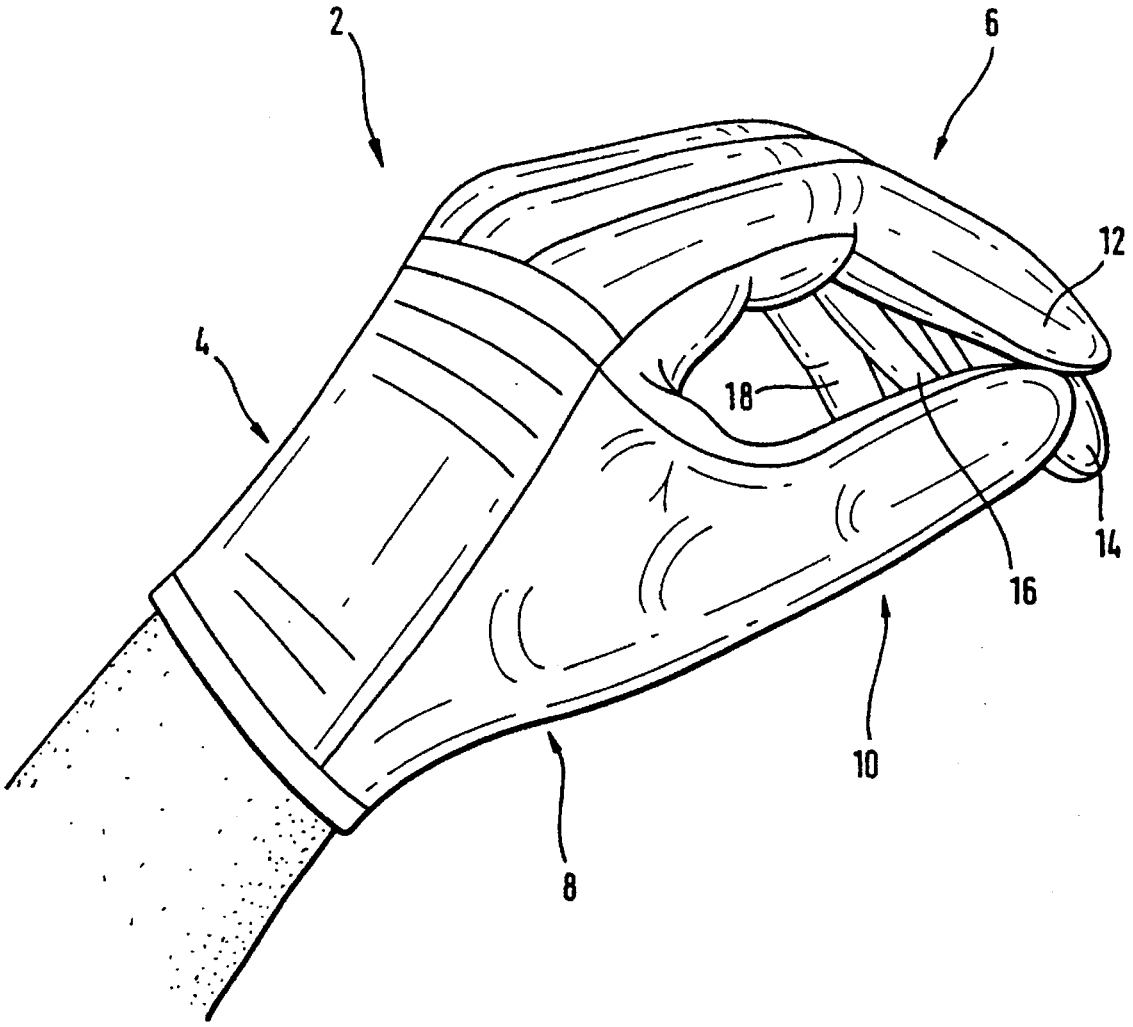
FIG. 1 is a representation of a possible embodiment of a glove according to the invention in use.

In FIG. 1, a glove of the invention is designated in its entirety by reference numeral 2. The glove 2 has the form of a glove as opposed to a mitten and comprises in the known manner a dorsal portion 4, a finger portion 6, a palm portion 8 not visible in FIG. 1, which is substantially disposed opposite the dorsal portion 4, and a thumb portion 10.

In FIG. 1, the glove 2 for a left hand is represented; it will be understood that a glove for the right hand has a correspondingly inverted shape.

The finger portion 6 includes four single glove fingers 12, 14, 16 and 18 for index, middle and ring as well as small fingers, respectively.

The dispositions for the single portions 4 through 10, their mutual connection, and the provision of various pleats to permit extending, buckling and stretching movements for increasing the mobility of the entire glove 2 are commonly known and will not be explained here for reasons of simplified representation.

Figure 2A:
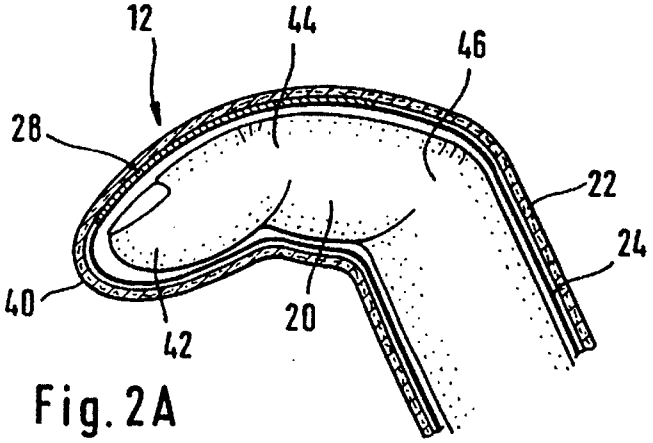
FIG. 2A is a sectional view of a finger portion in the closed position of a finger contained in it.

As can furthermore be seen from the drawing and particularly from FIGS. 2A through 4C, the glove 2 of the invention is characterised in that bistable spring elements having two stable end positions are provided, with the finger portion being kept deflected toward its closed position in the one end position while held in the comparatively open position, such as the extended position, in the other end position. In FIGS. 2A and 3A as well as in FIGS. 4A through 4C, one of glove fingers 12, 14, 16 or 18 of the finger portion 6 shall be selected, for example glove finger 12 for the index finger 20.

Figure 3A:
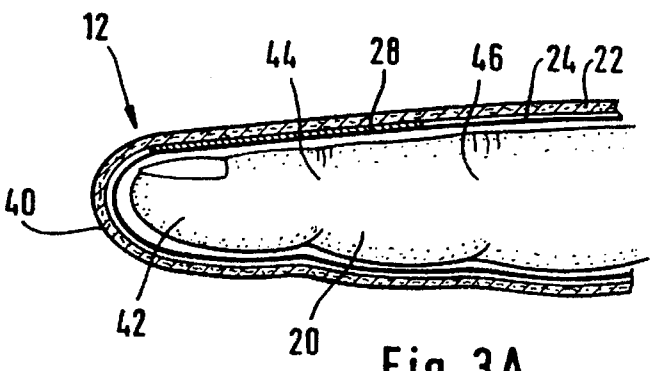
FIG. 3A is a representation corresponding to the one of FIG. 2A in the extended position.
Figure 4A:
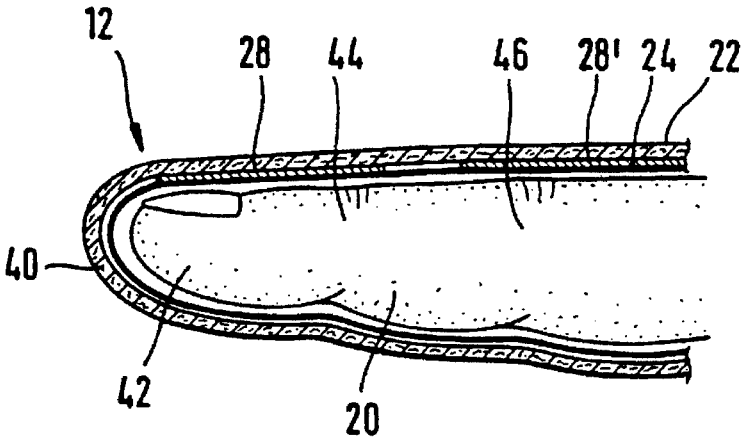
FIGS. 4A to 4C show possible modifications of the glove according to the invention.
Figure 4B:
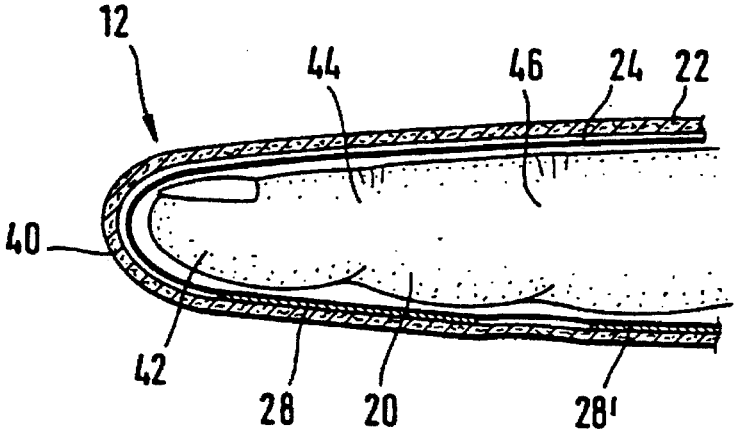
Figure 4C:
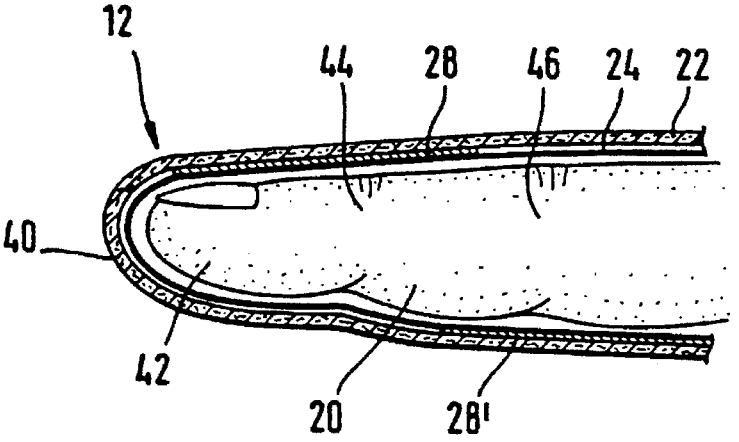

FIGS. 2A and 3A as well as FIGS. 4A through 4C each are sectional views of the glove finger 12, with FIG. 2A showing the index finger 20 in a bent or crooked position and FIGS. 3A and 4A through 4C showing the index finger 20 in an extended position. The glove finger 12 of the finger portion 6 comprises in the known manner an exterior glove material 22 and an interior lining material 24. The exterior material 22 consists of a material best suited to satisfy the demands made to it, e.g. wind and/or water tightness, abrasion resistance or the like. A typical material for the exterior material 22 is leather. Other materials such as e.g. imitation leather, plastic materials, linen or canvas—in a given case comprising a leather reinforcement—are, however, also possible. The lining material 24 serves to improve the overall wearing comfort, for absorbing sweat, as an additional thermal insulation etc. and consists of a material which is agreeable to the skin and pleasant to wear such as e.g. cotton, non-woven fabric, synthetic fibers having good breathing properties etc.

Figure 3B:
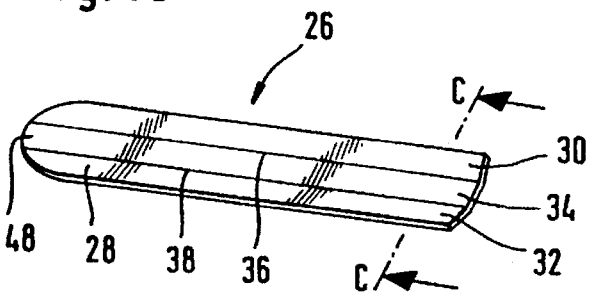
FIG. 3B is a representation of the spring element corresponding to the one of FIG. 2B in the stable end position corresponding to the extended position.
Figure 2B:
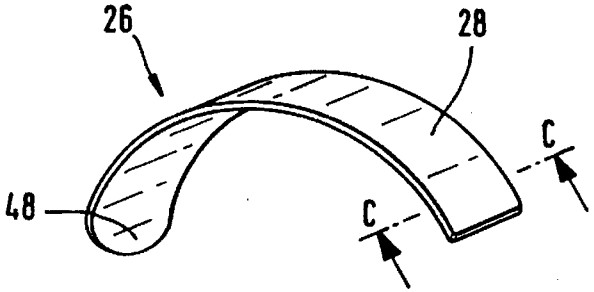
FIG. 2B is a perspective view of a bistable spring element in a stable end position corresponding to the closed position.

FIGS. 2B and 3B show a spring element 26 which is formed as a bistable spring element 28 having two stable end positions. FIG. 2B shows the one stable end position of spring element 28 wherein it is arcuately curved, and FIG. 3B shows the other stable end position of spring element 28 wherein it has a substantially extended/rectilinear orientation. In accordance with the sectional views of FIGS. 2C and 3C, the spring element 28 has an approximately level shape in the arcuately curved orientation, whereas the spring element 28 is approximately trough-shaped with laterally raised lateral portions 30 and 32 and a bottom surface 34 in its extended/rectilinear orientation according to FIG. 3B. In the transition between the bottom surface 34 and the lateral portion 30 or the bottom surface 34 and the lateral portion 32, respectively, the spring element 28 comprises folds or creases 36 and 38 in its extended/rectilinear orientation of FIG. 3B.

Figure 3C:
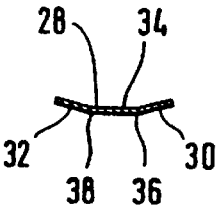
FIG. 3C is a sectional view taken along line C—C in FIG. 3B.

It should be noted that the sectional view according to FIG. 3C shows formation of the creases 36 and 38, or the amount of folding between bottom surface 34 and lateral portion 30, and between bottom surface 34 and lateral portion 32, respectively, in a strongly exaggerated manner for reasons of clarity.

Figure 2C:
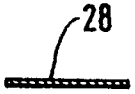
FIG. 2C is a sectional view taken along line C—C in FIG. 2B.

Owing to the formation of creases 36 and 38 which extend in the longitudinal direction of spring element 28, the spring element 28 is inherently stable in its extended/rectilinear orientation of FIG. 3B because the creases 36 and 38 stabilise the ribbon-shaped material of spring element 28 in its extended/rectilinear orientation of FIG. 3B in the manner of a corrugation effect. During transition from the extended/rectilinear orientation of FIG. 3B into the arcuately curved orientation of FIG. 2B, a certain force exceeding the stabilising effect of creases 36 and 38 in the longitudinal direction of spring element 28 must be applied onto the spring element 28, whereby the spring element 28 reverses into its arcuately curved orientation of FIG. 2B. In this arcuately curved orientation, the spring element 28 according to FIG. 2C is approximately level. That is, the stabilising effect owing to creases 36 and 38 in the longitudinal direction of spring element 28 has been neutralised, however the spring element 28 now has an inherent stability thanks to its arcuately curved orientation, for a resetting movement toward the orientation of FIG. 3B and for reestablishing the creases 36 and 38 also necessitates a certain force, namely the force which is required to reestablish the creases 36 and 38.

The arcuately curved orientation of FIG. 2B and the extended/rectilinear orientation of FIG. 3B are thus the stable end positions of the bistable spring element 28.

As can be taken from FIGS. 2A and 3A, such a bistable spring element 28 is for example disposed in a glove finger, e.g. in the glove finger 12 in the glove 2 of the invention. The arrangement of the spring element 28 is advantageously realised between the inside of the glove exterior material 22 and the outside of lining material 24. As a result, the spring element 28 is not visible from the outside because of the exterior material 22, such that the outer appearance of the glove 22 is not impaired and the spring element 28 is moreover protected from possible damage, and the finger contained inside the glove finger, e.g. the index finger 20, is protected by the lining material 24 from direct contact with the spring element 28. As the spring element 28 according to the figures is a leaf spring, particularly of metal, direct contact between the spring element 28 and the finger 20 is to be avoided if only for reasons of wearing comfort.

In one embodiment, at least one glove finger comprises a bistable spring element 28, but preferably each glove finger 12, 14, 16 and 18 comprises a bistable spring element 28. The thumb portion 10 my furthermore comprise a bistable spring element 28 between its exterior material 22 and the lining material 24. Instead of disposing one bistable spring element each in every glove finger, two or possibly even more than two such spring elements may be disposed in each glove finger.

FIGS. 2A and 3A show how a single bistable spring element 28 may be embedded between exterior material 22 and lining material 24:

The spring element 28 extends in the longitudinal direction of glove finger 12 (analogously also/or in the longitudinal direction of glove finger 14 and/or 16 and/or 18) starting from a respective tip 40 of the glove finger or a fingertip 42 of the finger 20, respectively, approximately as far as into the region of a first finger joint 44 or beyond it. A possible modification of the arrangement of spring element 28 in the manner shown in FIGS. 2A and 3A is to dispose two bistable spring elements 28 in each glove finger 12, 14, 16 and 18. The two spring elements 28 are then e.g. disposed consecutively in the longitudinal direction of the glove finger.

FIGS. 4A through 4C show possible embodiments wherein two bistable spring elements are disposed in at least one glove finger 12, 14, 16 or 18. According to FIG. 4A, the first spring element 28 extends from the tip 40 of the glove finger approximately as far as into the region intermediate the second finger joint 44 and the first finger joint 46, and the second spring element 28' extends from a region approximately in the vicinity of the first finger joint 46 beyond the neighboring knuckle joint into the region of the dorsal portion 4. Another possibility or modification would be to have the first spring element 28 extend from the tip 40 of the glove finger 12 approximately as far as into the region intermediate the first finger joint 46 and the neighboring knuckle joint, and the second spring element 28' beyond this knuckle joint into the region of the dorsal portion 4.

FIG. 4B shows the arrangment of the two bistable spring elements 28 and 28' on the inside of the glove finger 12.

FIG. 4C finally shows the arrangement of bistable spring elements 28 and 28' on the outside and inside of glove finger 12.

In the case where only one bistable spring element 28 is disposed in one of the glove fingers 12 through 18, the former may be given such a length as to extend—other than represented in the drawing or FIG. 2A, respectively—from the tip 40 beyond both finger joints 44 and 46 and beyond the knuckle joint into the dorsal portion of the glove. It would also be imaginable in the case of two bistable spring elements 28 and 28' to give them such a length as to be partially overlapping, e.g. in the region intermediate the finger joints 44 and 46.

When disposing either a single spring element 28 or two consecutive spring elements 28 in one glove finger, the spring element(s) 28 is/are disposed either in the dorsal regions of the glove fingers 12, 14, 16 and 18 or on the inside of each glove finger, or on the outside or back as well as on the inside.

The manner of disposing the spring element 28 or the spring elements 28 and 28' in the single glove fingers 12, 14, 16 and 18 depends on the respective demands made to the glove or purposes of its use, as well as on the material of which the glove is manufactured. As a general rule, the number of finger portions 28 and 28', respectively, to be disposed in the single glove fingers increases with the flexural stiffness of the glove material and with a stronger curvature of the single glove fingers in the closed position, such as in a motorcycle glove, and vice versa. The support characteristics obtainable by means of the bistable spring elements 28 and 28' when shifting the hand from the extended position into the closed position and when maintaining the hand in the closed position depend on the number and the arrangement of spring elements 28 and 28'.

In order to achieve better adaptation of the single spring elements 28 and/or 28' to the glove fingers 12, 14, 16 and 18, the spring elements are preferably given different lengths, i.e. they are adapted to the respective lengths of single glove fingers.

For using the glove 2 of the invention, a person puts on the glove 2 or the gloves 2 with the spring element(s) 28 in the glove fingers 12, 14, 16 and 18 being in the extended/rectilinear orientation shown in FIG. 3A or 3B, respectively. Owing to the creases 36 and 38, the spring elements 28 are maintained in this extended/rectilinear orientation which corresponds to the extended hand position. Owing to the inherent elasticity of the exterior material 22, the single glove fingers 12 through 18 may easily be slipped over the respective fingers despite the splint-like reinforcement by spring elements 28. The spring elements 28 furthermore do not or not substantially impede the movement by the gloved hand into a slightly curved position corresponding to the relaxed rest position of the hand, particularly when only a single spring element 28 is provided in the region intermediate the fingertip 42 and the first finger joint 44 as shown in FIGS. 2A and 3A. Such arrangement of the spring element 28 permits easier flexing of the second finger joint 46 and the following knuckle joint, whereby a hand position approximately corresponding to the one represented in FIG. 1 is possible. When grasping an object with the hand wearing the glove 2 of the invention, the fingers are shifted from the position of FIG. 1 or from the extended position of FIG. 3A into an increasingly crooked position according to FIG. 2A in order to pass from the extended position of FIG. 3A into a closed position wherein the single glove fingers 12 through 18 together with the thumb portion 10 are encompassing e.g. a tubular component, i.e. the handlebar or hand throttle of a motorcycle, the handle portion of a ski stick, the mast of a surfboard etc. The forces applied by the fingers onto the single spring elements 28 in the course of this grasping movement result in the stiffness of the spring elements 28, which is obtained in their longitudinal directions by the creases 36 and 38, being overcome and the single spring elements 28 reversing into the second stable end position of FIG. 2B having the arcuately curved orientation. When the spring elements 28 have completed their reversing movement and thereby attained the second stable end position of FIGS. 2A and 2B, the fingers of the gloved hand contained in the single glove fingers 12 through 18 and in a given case also inside the thumb portion 10 are supported in their closed positions. The term "supported" here is to mean that the stable end positions of the spring elements 28, i.e. their arcuately curved orientation contribute more or less strongly—depending on spring strength—to compensate the inherent flexural stiffness of the glove exterior material 22 which acts in the sense of a resetting force toward the extended position of glove 2. The gloved hand thus does not have to exert greater or lesser additional forces in addition to the gripping forces actually required at the handlebar, ski stick handle or mast in order to also compensate the resetting movements of the single glove fingers; these resetting movements are neutralised or compensated more or less entirely by the spring elements 28 being in the stable end position of FIG. 2B. Due to the fact that the gloved hand actually has to apply nothing but the actual grasping forces, whereas the resetting forces of the more or less stiff or inelastic exterior material are absorbed by the spring elements, more fatigue-free wearing of the glove 2 of the invention is possible even over prolonged periods of time.

Substantially identical effects may be obtained by consecutively disposing two spring elements 28 and 28' in the longitudinal direction of the glove fingers 12 through 18 instead of the embodiment of FIGS. 2A and 3A. Such consecutive arrangement of two spring elements in one glove finger is particularly advantageous whenever the exterior material 22 of the glove must be particularly sturdy and thick and consequently stiff, and/or whenever the design of the glove 2 does not permit provision of a single spring element 28 having a greater spring force and correspondingly greater thickness, such that shifting from the extended position into the closed position and particularly maintaining the closed position is supported by two consecutively disposed spring elements which, in a given case, have a correspondingly thinner form. As was mentioned above, in the case of consecutively disposing two spring elements in one glove finger, these are preferably disposed such that the second finger joint 46 is not covered by any one of the spring elements 28 or 28', for this second finger joint 46 must perform the strongest flexing—sometimes as far as 90° or more—when the fingers are bent in order to obtain the closed position, wherein such strong flexing might be impeded by a spring element 28 or 28' extending across the second finger joint 46.

As was also explained above, the spring element(s) (28') is/are disposed mostly in the dorsal region of the glove fingers 12 through 18 and also of the thumb portion 10. One reason herefor is that disposing the spring elements 28 having the shape of leaf springs might possibly impede sensory faculties in the region of the insides of the fingers. Another advantageous reason for disposing the spring elements 28 in the dorsal region of the glove fingers is that the finger joints 44 and 46 as well as the following knuckle joints obtain a certain protection or "armoring" due to the leaf-spring design of the spring elements 28. Particularly in the case of gloves for the motorcycle and ski sports this can be of particular advantage. Disposing the spring elements in the dorsal regions of the glove fingers is, however, not mandatory, as was already explained. Particularly in the case of very thick gloves where sensory faculties are anyway limited, the spring elements may also be mounted on the insides of the fingers. In this case the arrangement e.g. of FIG. 4C may moreover preferably be selected, wherein the lower spring element 28' extends from a region intermediate the first finger joint 46 and the second finger joint 44 as far as into the palm portion, whereby the distal phalanx comprising the finger pad, which has to perform the essential sensing tasks, is thus not covered by the spring element 28'. The distal phalanx may then in a given case be supported by the force of a spring element disposed on top as shown in FIG. 4C.

The spring force or hardness of spring elements 28 (28') is preferably adjusted such that particulary the closed position of the gloved hand, in which the spring elements 28 are in the stable end position represented in FIG. 2B, is supported by a force, however shift or return movement into the extended hand position wherein the spring elements 28 take the other stable end position shown in FIG. 3B is possible by nothing but a corresponding extending motion of the fingers of the hand. When two spring elements 28 and 28' are disposed consecutively, it may be advantageous to give the spring element 28 extending in the knuckle region a greater hardness or stiffness than the subsequent spring element 28 extending from the finger joint 44 to the fingertip 42 or glove tip 40, respectively, for the force applicable by fingers during an extending movement decreases with an increasing distance of the point where the force is to be generated from the knuckle joint.

As the muscles of the fingers can merely take the single fingers into the extended position but not substantially beyond it, assistance generally becomes necessary in order to shift the spring elements 28 and 28' from the closed position into the extended position. This assistance may simply consist in the thumb of the other hand pressing onto the outside of the spring elements 28 and 28' in order to straighten them into the extended position. The fingers, e.g. while closed around the handle of a motorcycle, may also be bent backwards far enough by a corresponding withdrawing motion of the hand for the spring elements 28 and 28' to be urged into the extended/rectilinear orientation. As the hand may readily be pulled from the glove and re-inserted into it even while the glove is in the closed position, it is not necessary to shift it into the extended position merely to put the gloves on or take them off. Only when the glove is to be used in the extended position, it becomes necessary to shift the spring elements 28 and 28' into the extended/rectilinear orientation.

The leaf springs or spring elements 28 are provided with a rounded portion 48 preferably at one end, in particular the end adjacent the fingertip 42, in order not to affect the wearing comfort of the glove and to avoid damage to the material. The spring elements 28 are furthermore provided with a protective coating, particularly of elastic plastic material or sewn textile material. Such a protective coating on the one hand prevents the exterior material 22 and/or the lining material 24 and/or any quilting seams or the like being damaged or severed by edges or punching burrs possibly remaining on the spring elements 28. Such a protective coating furthermore constitutes a protection for the metallic leaf springs or spring elements 28 against corrosion.

The description of the present invention was carried out by reference to a glove comprising the four glove fingers 12 through 18 and the thumb portion 10. The present invention may just as well be applied to a mitten wherein the finger portion 6 is formed in one part for receiving second, third, fourth and fifth fingers. In this one-part finger portion 6 one, preferably several bistable spring elements 28 may then be disposed in parallel with each other, whereby substantially the same effects and advantages as in the glove embodiment are obtainable. Specialised glove forms such as e.g. so-called two-finger or three-finger gloves can, of course, also be equipped in the sense of the present invention.

The design of the spring elements 28 is not limited to the described embodiment including the metal leaf spring which assumes two stable end positions. If, for example, only small forces are required to assist e.g. the closed position such as in the case of light canvas or synthetic gloves for the surfing or sailing sports or the like, the bistable leaf springs may also be manufactured of a suitable plastic material. Depending on the circumstances, it might furthermore be imaginable to use instead of metal leaf springs having two stable end positions, a metal strip of a so-called memory alloy which abruptly changes its shape as a result of certain temperature changes—for example generated by a battery-supplied heating element—such as e.g. between a shape according to FIG. 3B and a shape according to FIG. 2B and vice versa.

It may furthermore be advantageous in a given case if the single spring elements can be removed from the respective glove fingers from outside. For this purpose, pockets for receiving the spring elements and closed by velcro means may be formed on the glove fingers and disposed between the exterior glove material and the lining material. In this manner, for example harder spring elements may be replaced with softer ones, or vice versa, in order to enable optimum adaptation to the respective circumstances or to the individual wishes of a person using the gloves. Here it is also possible to stack two or more spring elements on top of each other and thereby achieve a particularly strong spring force or spring effect.

Forming closeable pockets for receiving the spring elements is also advantageous as the spring elements may be removed and recycled prior to discarding the glove(s).

What is claimed is:

1. A glove which comprises at least one dorsal portion (4), at least one finger portion (6), at least one palm portion (8) and a thumb portion (10), with the at least one finger portion (6) being biasable by at least one spring element (26) toward the closed position of said finger positions (6), wherein said spring element (26) has the form of a bistable spring element (28) which has two stable end portions, said finger portion (6) being kept deflected toward its closed position in the one end position, and said finger portion (6) being held in a comparatively open position such as the extended position in the other end position.

2. The glove according to claim 1, wherein said at least one finger portion (6) comprises a plurality of single glove fingers (12, 14, 16, 18), with a bistable spring element (28) being disposed in at least one of said glove fingers (12, 14, 16, 18).

3. The glove according to claim 1, wherein said at least one finger portion (6) comprises plurality of single glove fingers (12, 14, 16, 18), with one bistable spring element (28) being disposed in each one of said glove fingers (12, 14, 16, 18).

4. The glove according to claim 1, wherein said bistable spring element (28) is positioned inside said at least one finger portion and extends from a the tip (40) thereof approximately as far as into the region of the second finger joint (44).

5. The glove according to claim 1, wherein said bistable spring element (28) is positioned inside said at least one finger portion and extends from a tip (40) thereof approximately as far as into the region of the first finger joint (46).

6. The glove according to claim 1, wherein said bistable spring element (28) is positioned inside said at least one finger portion and extends from a tip (40) thereof beyond two finger joints (44, 46) and the knuckle joint as far as into the region of said dorsal portion (4).

7. The glove according to claim 1, wherein said at least one finger portion (6) comprises a plurality of single glove fingers (12, 14, 16, 18), with two bistable spring elements (28, 28') each being disposed in at least one glove finger (12, 14, 16, 18).

8. The glove according to claim 1, wherein said at least one finger portion (6) comprises a plurality of single glove fingers (12, 14, 16, 18), with two bistable spring elements (28, 28') each being disposed in every glove finger (12, 14, 16, 18).

9. The glove according to claim 7, wherein said two bistable spring elements (28, 28') are disposed consecutively in the longitudinal direction of said at least one glove finger (12, 14, 16, 18).

10. The glove according to claim 9, wherein a first of two spring elements (28) extends from a tip (40) of said glove finger (12, 14, 16, 18) approximately as far as into the region intermediate the second (44) and first (46) finger joints, and a second of said two spring elements (28') extends from a region approximately in the vicinity of the first finger joint (46) beyond the neighboring knuckle joint into the region of said dorsal portion (4).

11. The glove according to claim 9, wherein a first of said two spring elements (28) extends from a tip (40) of said glove finger (12, 14, 16, 18) approximately as far as into the region intermediate the first finger joint (46) and the neighboring knuckle joint, and a second of said two spring elements (28') extends beyond the knuckle joint into the region of said dorsal portion (4).

12. The glove according to claim 2, wherein said bistable spring elements (28) are disposed in the dorsal regions of said glove fingers (12, 14, 16, 18).

13. The glove according to claim 2, wherein said bistable spring elements (28) are disposed on the insides of said glove fingers (12, 14, 16, 18).

14. The glove according to claim 2, wherein said bistable spring elements (28) are disposed on the outside and inside, respectively, of each glove finger (12, 14, 16, 18).

15. The glove according to claim 2, wherein said bistable spring elements are provided (28) inside said single glove fingers (12, 14, 16, 18) and have different lengths.

16. The glove according to claim 2, wherein said bistable spring elements (28) are embedded between exterior material (22) and lining material (24) of said glove fingers (12, 14, 16, 18).

17. The glove according to claim 1, wherein at least one bistable spring element (28) is disposed in said thumb portion (10), too.

18. The glove according to claim 1, wherein said finger portion (6) is formed in one part like a mitten, with at least one, preferably several bistable spring elements (28) in parallel arrangement being disposed in said finger portion (6).

19. The glove according to claim 1 wherein said bistable spring element (28) is a metal leaf spring which reverses under the influence of an external force between a substantially extended/rectilinear orientation corresponding to the extended position and an arcuately curved orientation corresponding to the closed position.

20. The glove according to claim 19, wherein said leaf spring is formed to have a trough-like cross-section comprising a substantially planar bottom surface (34) and laterally raised lateral portions (30, 32) when in the extended/rectilinear orientation, and to have an approximately level cross-section when in the arcuately curved orientation.

21. The glove according to claim 19 wherein the force for the reversing movements of said leaf spring is applied by means of corresponding finger movements of a person wearing the glove (2).

22. The glove according to claim 19, wherein said leaf spring is provided with a protective coating, of elastic plastic material.

* * * * *